US006443118B2

(12) United States Patent
Thieleke et al.

(10) Patent No.: US 6,443,118 B2
(45) Date of Patent: Sep. 3, 2002

(54) COMBUSTION-ENGINED TOOL HAVING A COMBUSTION CHAMBER WITH A CONTROLLABLE PRESSURE BUILD-UP

(75) Inventors: Joachim Thieleke, Wasserburg; Kaveh Towfighi, Sigmarszell, both of (DE); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 8 days.

(21) Appl. No.: 09/741,290

(22) Filed: Dec. 19, 2000

(30) Foreign Application Priority Data

Dec. 23, 1999 (DE) ..... 199 62 698

(51) Int. Cl.[7] ..... F02B 19/18; F02B 71/01

(52) U.S. Cl. ..... 123/268; 123/465 C

(58) Field of Search ..... 123/260, 267, 123/268, 280, 283, 286, 46 R, 46 A, 46 H, 292

(56) References Cited

U.S. PATENT DOCUMENTS 3,638,632 A * 2/1972 Boling ..... 123/182.1
4,773,581 A * 9/1988 Ohtsu et al. ..... 123/46 SC

* cited by examiner

*Primary Examiner*—Gene Mancene
*Assistant Examiner*—Arnold Castro
(74) *Attorney, Agent, or Firm*—Sidley Austin Brown & Wood, LLP

(57) ABSTRACT

A portable, combustion-engined tool including a combustion chamber (1) in which a fuel gas in combusted upon ignition for building up pressure in the combustion chamber for driving the tool piston (8), an ignition device (20) for igniting the fuel gas in the combustion chamber (1), and gas drain means (43) provided in the combustion chamber (1) for controlling a pressure build-up therein.

4 Claims, 2 Drawing Sheets

COMBUSTION-ENGINED TOOL HAVING A COMBUSTION CHAMBER WITH A CONTROLLABLE PRESSURE BUILD-UP

BACKGROUND OF THE INVENTION

1. Field of the Invention

The present invention relates to a portable, combustion-engined tool and, in particular, a setting tool having a combustion chamber for receiving a fuel gas, and an ignition device for igniting the fuel gas for building up pressure in the combustion chamber for driving a setting piston adjoining the combustion chamber.

2. Description of the Prior Art

The drive energy in the tool described above is obtained by combustion of a fuel gas mixture, e.g., an air-fuel gas mixture, in the tool combustion chamber, and is transmitted to a fastening element, which need be driven in an object, via the piston.

The combustion-engined tool can have only one combustion chamber. However, a combustion-engined tool can have a combustion chamber that is divided in several chamber sections. In each case, the fuel gas mixture can be present in the chamber sections in different mixture ratios. For the sake of clarity, a combustion chamber would be considered which is divided only into chamber sections, a forechamber section and a main chamber section.

The combustion starts in the forechamber section by an electrical spark generated by the ignition device. Upon ignition of the mixture, a flame front starts to propagate radially with a relatively small velocity. The flame front pushes the unconsumed air-fuel gas mixture ahead of itself, and the unconsumed air-fuel gas mixture penetrates through the through-openings in the separation plate into the main combustion chamber section, creating there turbulence and pre-compression.

As the flame front reaches the through-openings, flame penetrates therethrough, due to the small cross-section of the openings, in a form of flame jets into the main chamber section, creating there a further turbulence. The thoroughly intermixed air-fuel gas mixture in the main chamber section ignites over the entire surface of the flame jets. The mixture burns with a high speed which substantially increases the effect of combustion as the losses which are caused by cooling, remain small.

A combustion chamber, which is divided in several chamber sections, can be formed as a collapsible combustion chamber having limiting opposite walls movable relative to each other.

An object of the present invention is a combustion-engined tool of a type discussed above having an increased capability of adjusting the energy transmitted to the piston.

SUMMARY OF THE INVENTION

This and other objects of the present invention, which will become apparent hereinafter, are achieved by providing a gas drain arrangement that permits to control pressure build-up in the combustion chamber by draining a controlled amount of the fuel gas mixture. The fuel gas mixture can be drained through one or more drain channel(s) formed in the bottom region of the combustion chamber or in the main chamber section. By controlling the amount of the fuel gas mixture in the combustion chamber, an energy transmitted to the piston can be directly controlled.

In accordance with one embodiment of the present invention, the gas drain arrangement has a drain channel with an adjustable cross-section. For controlling the channel cross-section, an adjustable throttle or an adjusting screw with a radial through-channel can be used. In both cases, the channel cross-section can be changed to drain a controlled amount of the gas upon pressure build-up in the combustion (main) chamber.

According to an advantageous embodiment of the present invention, the gas drain arrangement includes a check valve for closing the combustion chamber when an underpressure prevails therein. The return of the piston into its initial position, after the attachment element has be drived in, is effected as a result of thermal feedback, i.e., during a phase when underpressure prevails in the combustion chamber or the main chamber section. The piston is displaced into its initial position until it engages a stop. To maintain the underpressure in the combustion chamber, it should remain closed during the return movement of the piston. This function is performed by the check valve.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
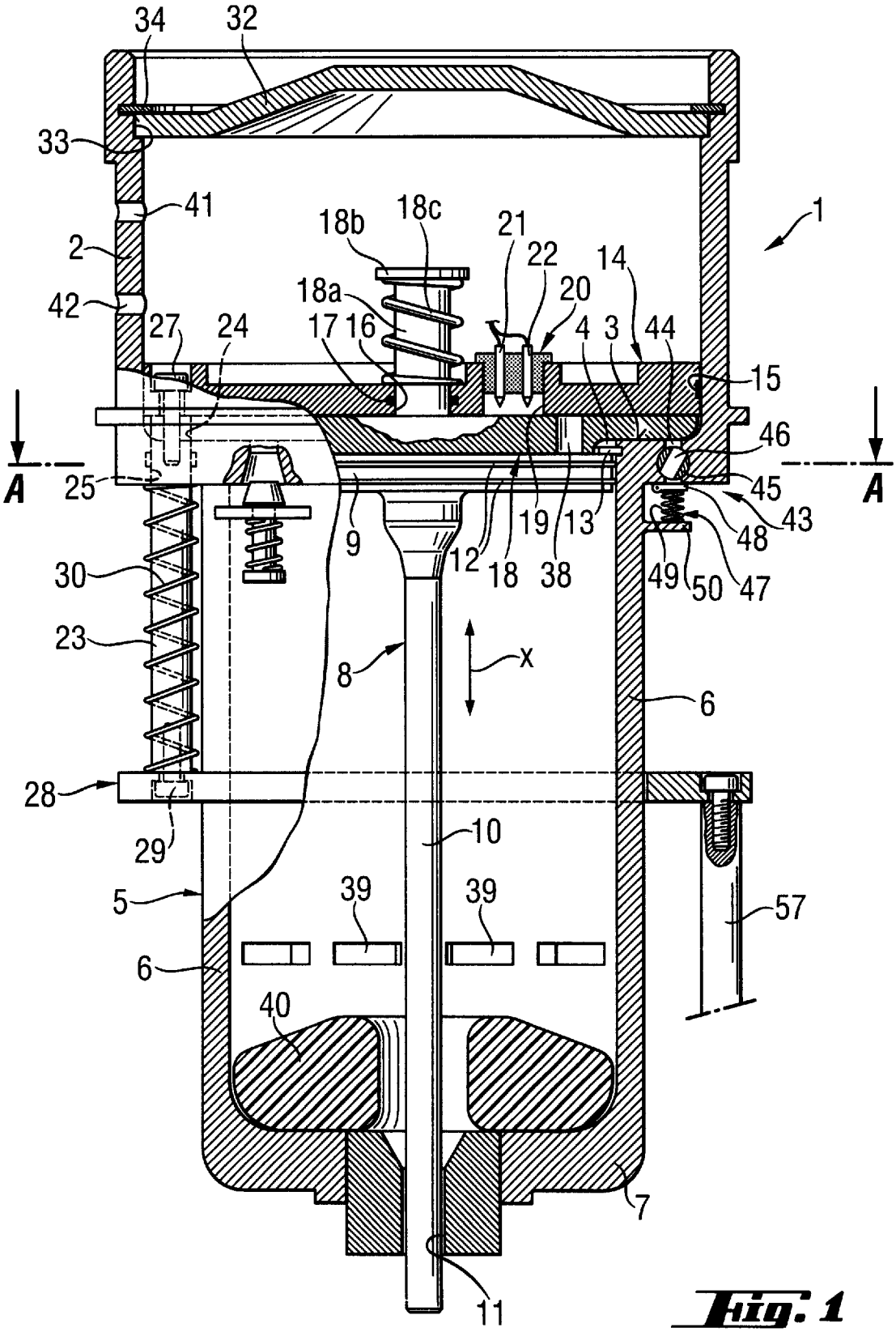
FIG. 1 shows an axial cross-sectional view of a combustion-engined tool according to the present invention in the region of the tool combustion chamber.

A combustion chamber 1 of an inventive combustion-engined tool, in particular, of a setting tool, which is shown in FIG. 1, has a cylindrical shape and includes a cylindrical wall 2 and a ring-shaped bottom 3 adjoining the cylindrical wall 3. In the center of the bottom 3, there is provided an opening 4. A guide cylinder 5, which as a cylindrical wall 6 and a bottom 7, adjoins the opening 4 in the bottom 3 of the combustion chamber 1. A piston 8 is slidably displaceably arranged in the guide cylinder 5 for displacement in the longitudinal direction X of the guide cylinder 5. The piston 8 consists of a piston plate 9 facing the combustion chamber 1 and a piston rod 10 extending from the center of the piston plate 9. The piston rod 10 projects through an opening 11 formed in the bottom 7 of the guide cylinder 5.

FIG. 1 shows a non-operational position of the setting tool in which the piston 8 is in its rearward off-position. The side of the piston plate 9 adjacent to the bottom 3 of the combustion chamber 1 is located closely adjacent to the bottom 3, with the piston rod 10 projecting only slightly beyond the bottom 7 of the guide cylinder 5.

Sealing rings 12 are provided on opposite sides of the piston plate 9 to seal the chambers on the opposite sides of the piston plate 9 from each other. For fixing the piston 8 in its rearward off-position, there is provided a stop 13.

Inside of the combustion chamber 1, there is provided a cylindrical plate 14 further to be called a movable combustion chamber wall or movable wall. The plane of the plate 14 extends transverse to the longitudinal direction of the tool. The movable wall 14 is displaceable in the longitudinal direction X of the combustion chamber 1. For separating the chambers on opposite sides of the movable wall 14, an annular sealing 15 is provided on the circumference of the movable wall. The movable wall 14 has a central opening 16, with an annular sealing 17 provided in the wall of the opening 16. Sidewise of the central opening 16 at a distance therefrom, there is provided a through-opening 19. An ignition device 20 is sealingly mounted in the opening 19. The ignition device 20 has two electrodes 21, 22 forming an electrical path for generating an ignition spark. The electrodes 21–22 face in a direction toward the bottom 3 of the combustion chamber 1.

A separation plate 18 is provided between the bottom 3 of the combustion chamber I and the movable wall 14. The separation plate 18 likewise has a circular shape and has an outer diameter corresponding to the inner diameter of the combustion chamber 1. The separation plate 18 has a plurality of axial through-openings 38 spaced from the center of the separation plate 18. The separation plate 18 is fixedly connected with a central projection 18*a* that extends into the through-opening 16 of the movable wall 14. At the free end of the central projection 18*a*, there is provided a ring-shaped circumferential flange 18*b* which is engaged by the movable wall 14 when it is displaced in the axial direction. A spring 18*c*, which is provided between the flange 18*b* and the opposite rear side of the movable wall 14 and is supported on the projection 18*a*, always biases the separation plate 18 toward the movable wall 14 by applying a biasing force to the flange 18*b*.

For displacing the movable wall 14, there are provided several, e.g., three drive rods 23 uniformly distributed along the circumference of the movable wall 14 and fixedly connected therewith. Only one of the drive rods 23 is shown in FIG. 1. The drive rods 23 extend parallel to the axis of the combustion chamber 1 and outside of the cylindrical wall 6 of the guide cylinder 5. The drive rods 23 extend through openings 24, respectively, formed in the separation plate 18 and through corresponding openings 25 formed in the bottom 3 of the combustion chamber 1. Each of the openings 25 is provided win a circumferential seal located in the surface defining the opening 25 for sealing the combustion chamber 1 from outside. The movable wall 14 is connected with drive rods 23 by, e.g., screws 27 which extend through the movable wall 14 and are screwed into the drive rods 23. The free ends of the drive rods 23 are connected with each other by a drive ring 28 which is arranged concentrically with the combustion chamber axis and which circumscribes the guide cylinder 5. The drive ring 28 is connected with the drive rods 23 by screws which extend through the drive ring and are screwed into the drive rods 23 through end surfaces of the free ends of respective drive rods 23. Each of the drive rods 23 supports a compression spring 30 extending between the bottom 3 of the combustion chamber 1 and the drive ring 28. The compression springs 30 are designed for pulling the movable wall 14 toward the bottom 3. The displacement of the movable wall 14 in a direction away from the bottom 3 is limited by a stop shackle 32 which is formed as a plate-shaped member. The shackle 32 is mounted in a circumferential groove 33 formed in the upper portion of the combustion chamber 1. The shackle 32 is secured in the groove 33 with a locking ring 34. The shackle 32 has an upwardly bulging section which serves as a stop for the central projection 18*a* of the separation plate 18.

An aeration/deaeration valve is provided in the bottom 3 of the combustion chamber 1. The aeration/deaeration valve serves for admitting fresh air into the combustion chamber 1 and for removal of waste gases from the combustion chamber 1, as it will be described in more detail further below. In the condition of the combustion chamber 1 shown in FIG. 1, the aeration/deaeration valve is open. The condition of the combustion chamber 1 shown in FIG. 1 corresponds to the off-condition of the tool.

At the lower end of the guide cylinder 5, there are provided openings 39 for letting air out of the guide cylinder 5 upon movement of the piston 8 toward the guide cylinder bottom 7. At the lower end of the guide cylinder 5, there is also provided damping means 40 for damping the movement of the piston 8. As soon as the piston 8 passes the openings 39, the waste gases are expelled from the guide cylinder 5 through the openings 39.

Two radial through-openings 41,41 are provided in the cylindrical wall 2 of the combustion chamber 1. Two conduits (not shown), which extend from outside into the through-openings 21, 22, communicate the combustion chamber 1 with a metering valve (likewise not shown) and provide for injection of, e.g., liquefied fuel gas into respective combustion chamber sections which are formed when the movable wall 14 and the separation wall 18 are displace to the operational end positions determined by the stop shackle 32, as also will be described in more detail further below.

In the bottom 3 of the combustion chamber 1, there is also provided a drain valve arrangement 43. The drain valve arrangement 43 includes a drain channel 44, an adjusting screw 45 with a radial channel 46, and a check valve 47. The check valve 47 is shown schematically and includes a flap valve 48 which is biased by a compression spring 49 against an outlet side of the drain channel 44, with the compression spring 49 being supported against a shoulder 50 provided on the cylindrical wall 6 of the guide cylinder 5. The check valve 47 insures flow of waste gases from the combustion chamber 1 through the drain channel 44 outside, on one hand, and prevents any flow of air from the surrounding environment into the combustion chamber 1 through the drain channel 44, on the other hand, when an underpressure is created in the combustion chamber 1.

Figure 2:
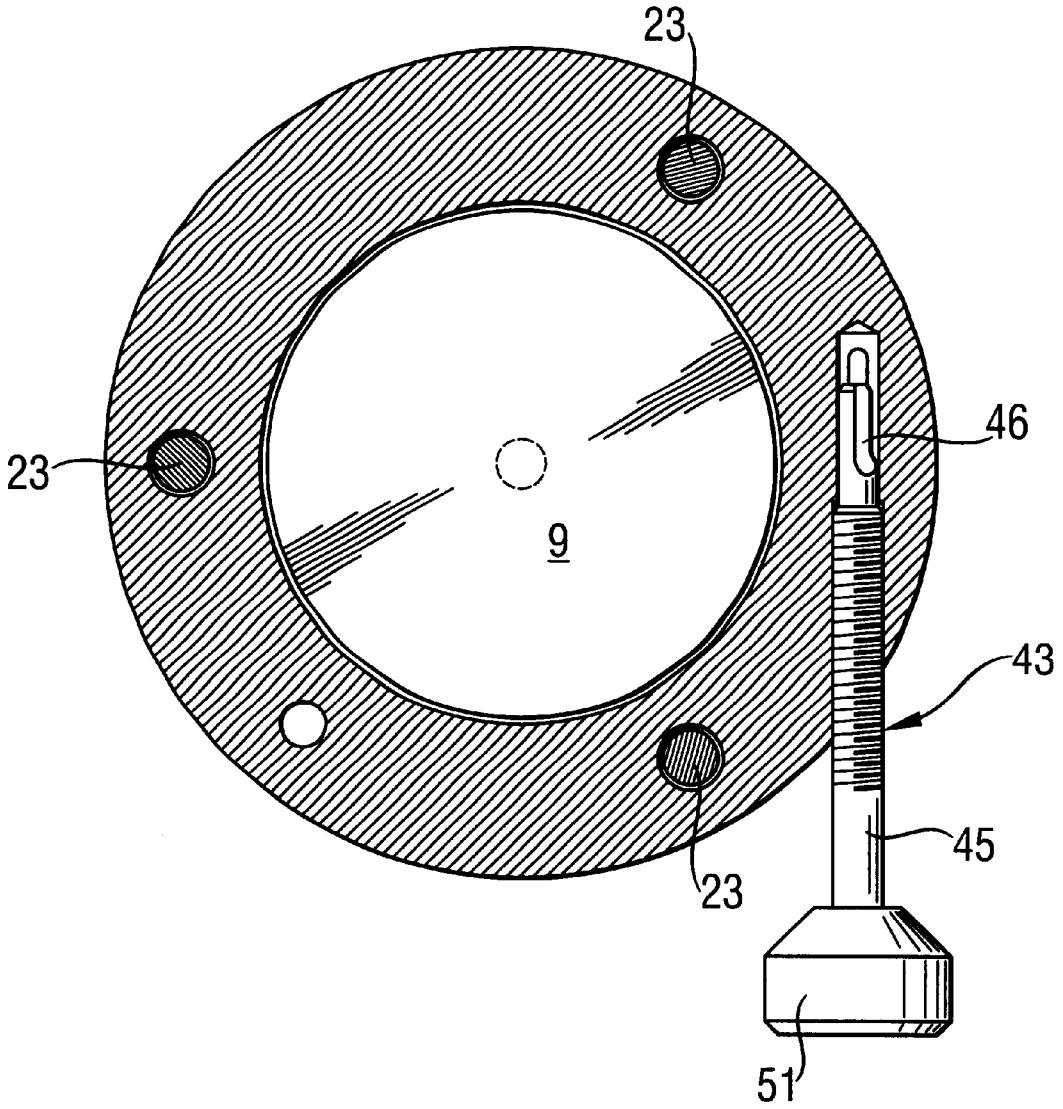
FIG. 2 a cross sectional view along line A—A in FIG. 1.

FIG. 2, as discussed above, shows a cross-sectional view along line A—A in FIG. 1. The cross-sectional view is taken through the drain valve arrangement 43. As shown in FIG. 2, for the actuation of the adjusting screw 45, there is provided a hand wheel 51. The adjusting screw 45 is screwed tangentionally in bottom 3 of the combustion chamber 1. The radial channel 46 of the adjusting screw 45 lies in the region of the drain channel 44 so that it becomes open or closed to a greater or lesser extent upon rotation of the adjusting screw 45.

Below, the operation of the setting tool, shown in FIGS. 1–2, will be described in detail.

FIG. 1 shows the condition of the combustion chamber 1 in the off position of the setting tool. The combustion chamber 1 is completely collapsed, with the separation plate 18 lying on the bottom 3 of the combustion chamber 1 and the movable wall 14 lying on the separation plate 18. In order to distinguish the movable wall 14 from the separation plate 18, for the clarity sake, they are shown slightly separated. The piston 8 is in its rearward off-position, which is determined by the stop 13, so that practically no space remains between the piston 8 and the separation plate 18 if one would disregard a small clearance therebetween. The position, in which the movable wall 14 lies on the separation plate 18, results from the compressing spring 30 biasing the drive ring 28 away from the bottom 3, with the ring 28 pulling the movable wall 14 via the drive rods 23. In this position, the drive ring 28 is still spaced from the aeration/deareation valve, which remains open.

When in this condition, the setting tool is pressed with its front point against an object, the fastening element should be driven in, a mechanism shown only schematically by an element 57, applies pressure to the drive ring 28 displacing it in the direction of the bottom 3 of the combustion chamber 1. This takes place simultaneously with the setting tool being pressed against the object. At that, the movable wall 14 is lifted off the separation plate 18 and entrains therewith, via the compression spring 18*c* and the flange 18, the separation plate 18. Upon displacement of the separation wall 18, a so-called main chamber section, which is formed between the separation plate 18 and the bottom 3, expands. During the expansion of the main chamber section, air is aspirated thereinto via still open aeration/deaeration valve.

Upon further pressing of the tool against the object, the drive ring 28 is displaced further in a direction toward the bottom 3, and, in a while, the projection 18*a* engages the shackle 32. If the drive ring 28 is displaced further toward the bottom 3, the movable wall 14 separates from the separation plate 18, whereby a so-called forechamber section is formed between the movable wall 14 and the separation plate 18. Air into the forechamber section is aspirated through the aeration/deaeration valve and the through-openings 38 formed in the separation plate 18.

As soon as the movable wall 14 and the separation plate 18 pass the respective openings 41, 42, in principle, an injection of a metered amount of the liquified fuel gas into the forechamber and main chamber sections can start. At the end of the displacement of the movable wall 14, the aeration/deaeration valve is closed by the drive ring 28.

In the completely expanded position of the forechamber and main chamber sections, the movable wall 14 and the separation plate 18 become locked. This is effected by actuation of an appropriate lever or a trigger of the tool. The locking can take place shortly after the actuation of the trigger or shortly after ignition of the fuel gas mixture in the combustion chamber 1 of the setting tool. Upon actuation of the ignition device 20, an electrical spark ignites a preliminary formed mixture of the air and the fuel gas in the forechamber section of the combustion chamber 1. Upon ignition of the mixture, a flame front starts to propagate radially with a relatively small velocity. The flame front pushes the unconsumed air-fuel gas mixture ahead of itself, and the unconsumed air fuel gas mixture penetrates through the through-openings 38 in the separation plate 18 into the main combustion chamber section, creating there turbulence and pre-compression.

As the flame front reaches the through-openings 38, flame penetrates therethrough, due to the small cross-section of the openings 38, in a form of flame jets into the main chamber section, creating there a further turbulence. The thoroughly intermixed air-fuel gas mixture in the main chamber section ignites over the entire surface of the flame jets. The mixture bums with a high speed which substantially increases the effect of combustion.

The combustible mixture in the main chamber section impacts the piston 8, which moves with a high speed toward the bottom 7 of the guide cylinder 5, forcing the air from the guide cylinder 5 out through the openings 39. Upon the piston plate 9 passing the openings 39, the exhaust gas in discharged therethrough. The piston rod 10 effects setting of a fastening element.

The amount of energy transmitted to the piston 8 depends, among others, on the pressure build-up in the main chamber section. This pressure depends on the extent of opening of the drain channel 44 determined by a selected adjustment position of the adjusting screw 45.

After setting or following the combustion of the air-fuel gas mixture, the piston 8 is brought to its initial position, which is shown in FIG. 1, as a result of thermal feedback produced by cooling of the flue gases which remain in the combustion chamber 1 and the guide cylinder 5. As a result of cooling of the flue gases, an underpressure is created behind the piston 8 which provides for return of the piston 8 to its initial position. The combustion chamber 1 should remain sealed until the piston 8 reaches its initial position. This means that the aeration/deaeration valve also should remain closed, as well as the drain valve arrangement 43. The closing of the drain channel 44 is effected with the valve flap 48, which is biased by the spring 49 into a position in which it closes the channel 44 until the underpressure exists in the main chamber section of the combustion chamber 1.

After it is insured that the piston 8 reached its initial position, which is shown in FIG. 1, again, the movable wall 14 and/or the drive ring 28, and/or the aeration/deaeration valve is (are) unlocked. The compression springs 30 bias the drive ring 28 in a direction away from the bottom 3 of the combustion chamber 1, whereby the aeration/deaeration valve completely opens. Upon movement of the drive ring 28 away from the bottom 3, the drive rods 23 pull the movable wall 14 in a direction toward the bottom 3. Upon the movement of the movable wall 14 in the direction toward the bottom 3, the compression spring 18*c* biases, via the flange 18*b* of the projection 18*a* of the separation plate 18, the separation plate 18 toward the movable wall 14. Thus, first, the forechamber section is deaerated, with the flue gases exiting through the aeration/deaeration valve. After the movable wall 14 abuts the separation plate 18, both move in the direction toward the bottom 3, with now the main chamber section being deaerated through the aeration/deaeration valve. In a while, the separation plate 18 abuts the bottom 3, with the movable wall 14 lying on the separation plate 18. The combustion chamber 1 becomes completely collapsed and free of flue gases. Now, an aeration process can begin anew upon the next setting of a fastening element.

The structure and operation of the tool was discussed above with reference to an embodiment with a collapsible combustion chamber. However, it should be clear that the present invention can be used with a setting tool or another tool in which the combustion chamber wall and/or separation plate are not displaced in the axial direction of the combustion chamber. In effect the present invention can be used with any tool the combustion chamber of which consists of a single chamber section and is not divided into forechamber and main chamber sections.

Although the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A portable, combustion-engined tool, comprising a piston (8); a combustion chamber (1) in which a fuel gas is combusted upon ignition for building up pressure in the combustion chamber for driving the piston (8); an ignition device (20) for igniting the fuel gas in the combustion chamber (1); and gas drain means (43) provided in the combustion chamber (1) for controlling a pressure build-up therein wherein the gas drain means (43) comprises a drain channel (44) with an adjustable cross-section, and wherein the gas drain means (43) comprises an adjusting screw (45) having a radially extending through-channel (46) and aligned with the drain channel (44) for adjusting the cross-section of the drain channel (44).

2. A portable, combustion-engined tool as set forth in claim 1, wherein the gas drain channel is formed by an adjustable throttle.

3. A portable, combustion-engined tool as set forth in claim 1, wherein the gas drain means (43) comprises a check valve (47) for closing the combustion chamber (1) when an under-pressure prevails therein.

4. A portable, combustion-engined tool as set forth in claim 1, wherein the gas drain means (43) is located in the bottom region of the combustion chamber (1).

* * * * *